US006866085B2

(12) United States Patent
Hashimoto et al.

(10) Patent No.: US 6,866,085 B2
(45) Date of Patent: Mar. 15, 2005

(54) PLASTICALLY WORKED CAST ALUMINUM ALLOY PRODUCT, A MANUFACTURING METHOD THEREOF AND A COUPLING METHOD USING PLASTIC DEFORMATION THEREOF

(75) Inventors: Akio Hashimoto, Shizuoka-ken (JP); Takaaki Ikari, Shizuoka-ken (JP); Hiromi Takagi, Kariya (JP); Sumi Yoshikawa, Kariya (JP)

(73) Assignees: Nippon Light Metal Co., Ltd., Tokyo (JP); Denso Corporation, Aichi-Ken (JP)

( * ) Notice: Subject to any disclaimer, the term of this patent is extended or adjusted under 35 U.S.C. 154(b) by 147 days.

(21) Appl. No.: 10/144,638

(22) Filed: May 13, 2002

(65) Prior Publication Data

US 2003/0037848 A1 Feb. 27, 2003

Related U.S. Application Data

(62) Division of application No. 09/757,838, filed on Jan. 10, 2001, now abandoned.

(30) Foreign Application Priority Data

Jan. 19, 2000 (JP) ..... 2000-009798

(51) Int. Cl.[7] ..... B22D 27/09

(52) U.S. Cl. ..... 164/113; 164/122; 164/76.1; 164/120; 228/136

(58) Field of Search ..... 164/113, 122, 164/76.1, 120; 228/256, 257, 258, 259, 260, 261, 262, 155, 135, 136; 148/549, 552

(56) References Cited

U.S. PATENT DOCUMENTS 5,230,754 A 7/1993 Setzer et al.

FOREIGN PATENT DOCUMENTS

JP 59189055 A * 10/1984 ..... B22D/17/00
JP 06-145866 5/1994

OTHER PUBLICATIONS

"Aluminum and Aluminum Alloys", ASM International, 1993, pp 89,98 and 99.*

ASM Handbook: "Casting", vol. 15, pp. 476–486, Sep. 1988; May 1992.

* cited by examiner

*Primary Examiner*—George Wyszomierski
*Assistant Examiner*—Janelle Morillo
(74) *Attorney, Agent, or Firm*—Webb Ziesenheim Logsdon Orkin & Hanson, P.C.

(57) ABSTRACT

The newly proposed cast aluminum alloy product has the composition consisting of 6.5–8.0% Si, 0.25–0.45% Mg, 0.08–0.40% Fe, 0.001–0.01% Ca, P less than 0.001%, 0.02–0.1% Ti, 0.001–0.01% B, optionally one or two of 0.05–0.3% Cr and 0.05–0.2% Mn, and the balance being Al except inevitable impurities. It has the metallurgical structure that an α-Al phase in a surface layer is of average grain size different by 50 μm or less from an α-Al phase in an inner part, and that a maximum size of eutectic Si particles is 400 μm or smaller. It is manufactured by injecting a molten aluminum alloy into metal dies at an injection speed of 0.05–0.25 m/second, and then cooling the injected alloy at a cooling speed of 20° C./or higher in a temperature range between liquidus and solidus curves in a state charged with a pressure of 30 MPa or higher. Since the cast product is good of ductility, it is used as a member for coupling another member therewith by calking or the like.

1 Claim, 2 Drawing Sheets

A METALLURGICAL STRUCTURE OF
A CAST ALUMINUM ALLOY PRODUCT
(Alloy No. 1, Casting Condition No. 1, ×100)

A METALLURGICAL STRUCTURE OF A CAST ALUMINUM ALLOY PRODUCT (Alloy No. 3, Casting Condition No. 1, ×100)

COMPARISON OF MAXIMUM PARTICLE SIZES OF SEGREGATES the present invention (Alloy No. 1, Casting Condition No. 1)

a comparative example (Alloy No. 3, Casting Condition No. 1)

PLASTICALLY WORKED CAST ALUMINUM ALLOY PRODUCT, A MANUFACTURING METHOD THEREOF AND A COUPLING METHOD USING PLASTIC DEFORMATION THEREOF

CROSS REFERENCE TO RELATED APPLICATIONS

This application is a divisional of U.S. patent application Ser. No. 09/757,838, filed Jan. 10, 2001, now abandoned, and claims priority therefrom.

BACKGROUND OF THE INVENTION

The present invention relates to a cast aluminum alloy product to which another member can be coupled by plastic deformation such as calking, a method of manufacturing thereof and also a coupling method using plastic deformation thereof.

A part, such as a protector in a braking system for an automobile enclosing a hydraulic circuit therein, has a regulator at an outlet of the hydraulic circuit for regulating a flow rate of oil. Since the regulator is generally made of steel or synthetic resin, which can not be fixed to the aluminum protector by welding, plastic deformation (e.g. calking) of the aluminum member has been adopted for fixing the regulator.

The aluminum protector for a braking system of an automobile is estimated to be plastically deformed for fixing other members, as mentioned above. In this regard, such a wrought alloy as Al—Si—Mg relatively high of toughness has been used so far for such the purpose. However, since the wrought alloy is relatively expensive compared with a cast alloy, it is expected to provide a protector made of a cheap cast alloy.

A cast aluminum alloy product generally includes such cast defects as blowholes and comprises a metallurgical structure wherein α-Al phase comes out as a matrix with ununiform grain size. Segregation of an eutectic Si phase grown to a coarse size as well as dispersion of primary Si are often observed in the matrix. Due to such the metallurgical structure, the cast aluminum alloy product is poor of ductility and so regarded as a member improper to be coupled with another member by plastic deformation.

In actual, JP 6-145866A discloses a cast aluminum alloy product for use as a protector of an automobile braking system, whereby growth of isometric crystals is promoted by addition of Ti and B to reduce occurrence of blowholes. Even the proposed aluminum alloy product is insufficient of ductility, so it can not be yet used as a member to be coupled with another member.

SUMMARY OF THE INVENTION

The present invention aims at provision of a cast aluminum alloy product useful as a member to be coupled with another member by such plastic deformation as calking without defects as above-mentioned. The cast product is improved in ductility by addition of Ca, Ti and B with reduction of P content and by size-control of α-Al grains and eutectic particles.

The newly proposed cast aluminum alloy product has the composition consisting of 6.5–8.0 mass % Si, 0.25–0.45 mass % Mg, 0.08–0.40 mass % Fe, 0.001–0.01 mass % Ca, P less than 0.0015 mass %, 0.02–0.1 mass % Ti, 0.001–0.01 mass % B, optionally one or two of 0.05–0.3 mass % Cr and 0.05–0.2 mass % Mn, and the balance being Al except inevitable impurities. The cast aluminum alloy product has the metallurgical structure that an α-Al phase grain in a surface layer from a surface to a depth of 1 mm is of average grain size different by 50 μm or less from an α-Al phase grain in an inner part, and an eutectic Si phase is controlled at a particle size of 400 μm or smaller.

Another member is coupled to the cast aluminum alloy product by partial plastic deformation of the cast aluminum alloy product.

After a molten aluminum alloy is adjusted to the specified composition, it is injected into a cavity of metal dies at a speed of 0.05–0.25 m/second and then cooled at a cooling speed of 20° C./second or higher in a temperature range between liquidus and solidus curves in a state charged with a pressure of 30 MPa or higher.

A cast body has a cave or hole for coupling another member thereto. The mating member can be coupled to the cast aluminum alloy product by arranging the mating member in the cave or hole and then plastically deforming a part above or around the cave or hole so as to realize metal flow to the cave or hole.

A cast aluminum alloy product generally includes cast defects such as blowholes and segregates of an eutectic phase grown to a coarse particle, with big difference in average grain size of an α-Al phase between a surface layer and an inner part. The big difference in average grain size, cast defects and segregation of the eutectic Si phase cause partial decrease of elongation of the cast aluminum alloy product, resulting in irregularity of elongation or plastic deformation as well as cracking, so that the cast aluminum alloy product is not regarded as a member suitable to be coupled with another member.

The inventors have researched and examined effects of difference in average grain size, cast defects and segregation on ductility from various aspects, and have found that a cast aluminum alloy product capable of coupling another member therewith by plastic deformation is obtained by addition of Ca, Ti and B to an aluminum alloy with reduction of P content to reform an eutectic phase to fine particles and by control of casting conditions to inhibit occurrence of cast defects and to decrease a difference in average grain size of an α-Al phase grain size between a surface layer and an inner part of the cast product.

DETAILED DESCRIPTION OF THE INVENTION

Figure 1:
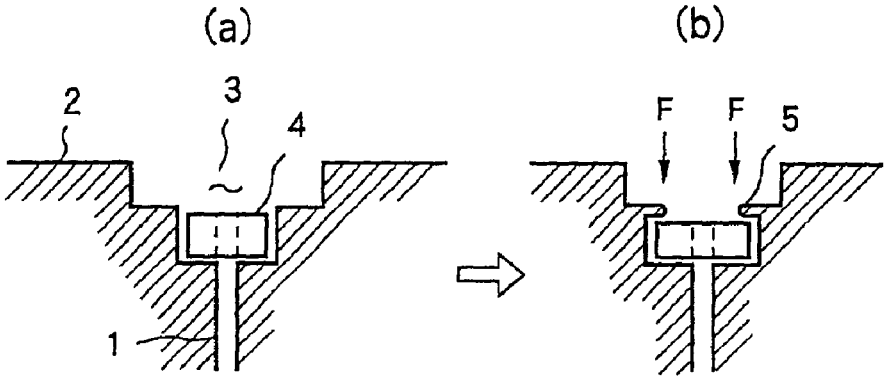
FIG. 1 is a view for explaining calking a regulator at a cave of an aluminum alloy product.

The composition, the metallurgical structure and the manufacturing conditions specified in the present invention have meanings explained as follows:

[Alloying Design]

Si: 6.5–8.0 mass %:

Si is an alloying element which precipitates as $Mg_2Si$, eutectic Si, etc. effective for improvement of mechanical strength and castability. Such the effect is clearly noted by addition of Si at a ratio of 6.5 mass % or more. However, excessive addition of Si above 8.0 mass % causes segregation of coarse eutectic Si particles and reduces toughness of a cast alloy.

Mg: 0.25–0.45 mass %:

Mg is an alloying element which precipitates as $Mg_2Si$ effective for improvement of mechanical strength. The effect of Mg on mechanical strength is clearly noted by addition of Mg at a ratio of 0.25 mass % or more. However, excessive addition of Mg above 0.45 mass % causes various defects such as inclusion of oxides and poor fluidity during casting.

Fe: 0.08–0.40 mass %:

Fe is an alloying element effective for inhibiting burning of metal dies. Such the effect is clearly noted by addition of Fe at a ratio of 0.08 mass % or more. However, excessive addition of Fe above 0.40 mass % causes generation of coarse Al—Fe—Mg—Si intermetallic compounds, resulting in reduction of toughness.

Ca: 0.001–0.01 mass % and P: less than 0.0015 mass %:

The additive Ca with reduction of P content to a possible lowest level suppresses generation of primary Si particles and modifies eutectic Si particles, so as to improve a cast aluminum alloy product in ductility as well as strength and toughness. The effect of Ca on modification of eutectic Si particles is clearly noted by addition of Ca at a ratio of 0.001 mass % or more (preferably 0.002 mass % or more). However, such the effect is not realized if P content exceeds 0.0015 mass %. Fluidity and castability of a molten aluminum alloy are degraded by P content above 0.0015 mass % or addition of Ca above 0.01 mass %.

0.02–0.1 mass % Ti and 0.001–0.01 mass % B:

Ti and B are well-known alloying elements effective for minimization of an α-Al phase grain. In addition to such the effect, the inventors have found from various examinations that Ti and B are also effective for suppressing segregation of an eutectic Si phase if an aluminum alloy is cooled at a cooling speed of 20° C./second or higher in a temperature range between liquidus and solidus curves after injection into metal dies. The effect on suppression of segregation is clearly noted by addition of Ti at a ratio of 0.02 mass % or more and B at a ratio of 0.001 mass % or more. However, excessive additions of Ti above 0.1 mass % and B above 0.01 mass % are likely to cause generation of coarse compounds and to reduce ductility of a cast aluminum alloy product.

One or two of Cr: 0.05–0.3 mass % and Mn: 0.05–0.2 mass %:

Cr and Mn are optional elements, which are added to an aluminum alloy as occasion demands. Recrystallization, which unfavorably reduces mechanical strength, of a plastically deformed part coupled with another member is inhibited by addition of Cr. Such the Cr effect is clearly noted by addition of Cr at a ratio of 0.05 mass % or more. The additive Mn precipitates as Al(Fe, Mn)Si effective for suppressing generation of coarse Al—Fe—Mg—Si intermetallic compounds which put harmful influences on toughness of a cast aluminum alloy product. Such the Mn effect is clearly noted by addition of Mn at a ratio of 0.05 mass % or more. However, excessive addition of Cr above 0.3 mass % or Mn above 0.2 mass % degrades castability of a molten aluminum alloy.

[Metallurgical Structure]

The cast aluminum alloy product according to the present invention has the metallurgical structure that an α-Al phase grain in a surface layer from a surface to a depth of 1 mm is differentiated in average grain size by 50 μm or less from an α-Al phase grain in an inner part, a size of eutectic Si particles is controlled at 400 μm or smaller. Such the small difference in size of α-Al grains between the surface layer and the inner part as well as the size-control of eutectic Si particles are realized by the specified alloying composition together with control of manufacturing conditions.

Due to the small difference in size of α-Al grains between the surface layer and the inner part, the cast aluminum alloy product is good of ductility without discontinuity of physical properties. The cast aluminum alloy product is also plastically deformed for coupling another member thereto without occurrence of cracks, since generation of coarse eutectic Si particles acting as origins to start collapse during plastic deformation is suppressed. If a cast aluminum alloy product contains eutectic Si particles above 400 μm in maximum particle size on the contrary, it can not be used as a protector for a braking system enclosing a hydraulic circuit therein due to poor cracking resistance, since such coarse eutectic Si particles act as origins for cracking.

[Casting Conditions]

After a molten aluminum alloy is adjusted to a predetermined composition, it is injected into a cavity of metal dies by a die-casting process. Injection of the molten alloy is performed at a speed of 0.05–0.25 m/second. An injection speed of 0.05 m/second or higher ensures fluidization of the molten alloy to every nook and corner of the cavity, while an injection speed of 0.25 m/second or less inhibits occurrence of blowholes which put harmful influences on airtightness.

The injected molten alloy is pressed in the cavity with a pressure enough to crush blowholes, which are likely to act as origins for collapse during plastic deformation. Blowholes are effectively crushed by application of a pressure of 30 MPa or higher.

The injected molten aluminum alloy is cooled in the cavity at a speed of 20° C./second or higher in a temperature range between liquidus and solidus curves. Such the controlled cooling speed in the temperature range enables co-presence of Ti and B even after the molten alloy reaches a temperature on the solidus curve, so that Ti and B still effectively minimize α-Al grains and suppress segregation of eutectic Si particles. If the molten alloy is slowly cooled at a speed below 20° C./second, Ti and B are consumed for minimization of α-Al grains in prior to precipitation of the eutectic Si phase. Therefore, the effect of Ti and B on suppressing segregation of eutectic Si particles would not be realized.

[Coupling Method]

A molten aluminum alloy is cast to a profile having a cave or hole. Such a cave or hole is easily formed by use of metal dies, which has a tubercle or projection extending to a cavity at a position corresponding to the cave or hole. For instance, a cast aluminum alloy product has a shape partially shown in FIG. 1, wherein a passage 1 serving as a part of a hydraulic circuit is formed in a cast aluminum alloy body 2, and a cave 3 is formed at a position where the passage 1 opens on a surface of the cast body 2. After a regulator 4 is arranged in the cave 3 (FIG. 1(*a*)), a working pressure F is applied to a part above the cave 3 so as to form a plastically deformed part 5 by metal flow to the cave 3 (FIG. 1(*b*)). Consequently, the regulator 4 is clamped between a bottom of the cave 3 and the plastically deformed part 5.

EXAMPLE

After a molten aluminum alloy was adjusted to each composition own in Table 1, it was degasified and cleaned by removal of slugs. The molten aluminum alloy prepared in this way was cast to a rectangular parallelepiped shape under conditions indicated in Table 2 by a laminar flow die-casting method.

TABLE 1

ALUMINUM ALLOYS USED IN EXAMPLE

| Alloy | components (mass %) | | | | | | | | |
|---|---|---|---|---|---|---|---|---|---|
| No. | Si | Fe | Mg | Ti | B | Mn | Cr | Ca | P |
| 1 | 7.2 | 0.25 | 0.31 | 0.02 | 0.002 | <0.01 | <0.01 | 0.0076 | 0.0007 |
| 2 | 6.9 | 0.28 | 0.33 | 0.05 | 0.004 | 0.12 | 0.14 | 0.0082 | 0.0008 |
| 3 | 7.2 | 0.27 | 0.33 | <0.01 | <0.001 | <0.01 | <0.01 | 0.0078 | 0.0008 |

TABLE 2

CASTING CONDITIONS

| | Present Invention | Comparative Example | | |
|---|---|---|---|---|
| Condition No. | 1 | 2 | 3 | 4 |
| a temperature (° C.) of metal dies | 160 | 160 | 160 | 160 |
| a temperature (° C.) of a molten alloy | 720 | 720 | 720 | 720 |
| an injection speed (m/second) | 0.1 | 0.3 | 0.1 | 0.1 |
| a pressure (MPa) during casting | 50 | 50 | 20 | 50 |
| a cooling speed (° C./second) | 30 | 30 | 30 | 10 |

After each cast body was solution treated 2 hours at 520° C., it was quenched in water and then aged 4 hours at 180° C.

The aged cast body was subjected to observation of its metallurgical structure and a mechanical test. In observation of the metallurgical structure, average sizes of α-Al grains in a surface layer from a surface to a depth of 1 mm and in an inner part of the cast body were measured, and a difference therebetween was calculated. Eutectic Si particles segregated at boundaries of α-Al grains were also observed to measure their maximum particle size. Specific gravity of each die-cast product together with cast products manufactured by gravity casting the same aluminum alloys were measured by Archimedes's method. Suppose that specific gravity of the die-cast product is a measured value while specific gravity of the gravity-cast product is a real value, a porosity of each die-cast product was calculated according to the formula of:

a porosity (%)=(a real specific gravity−a measured specific gravity)/a real specific gravity×100

Results are shown in Table 3. It is noted that Sample Nos. 1 and 5, which had the specified alloying compositions and the metallurgical structure controlled according to the present invention, were superior of tensile strength, yield strength and ductility. There was only a small difference in size of α-Al grains between a surface layer and an inner part, and a porosity value of Sample No. 1 or 5 was also small.

Figure 2:
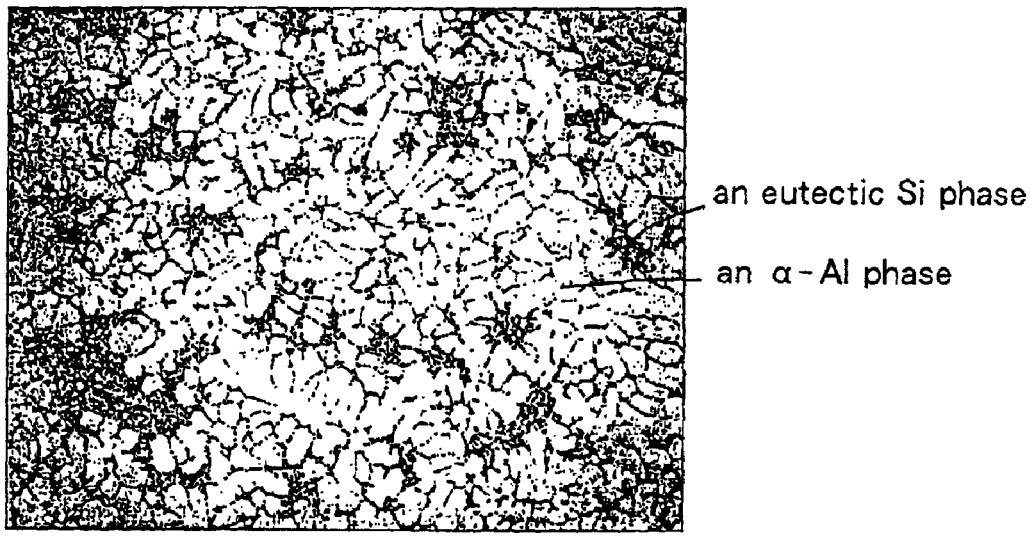
FIG. 2 is a microscopic photograph illustrating a metallurgical structure of an aluminum alloy product according to the present invention.

Segregation of coarse eutectic particles were not observed, as shown in FIG. 2 which is a microscopic photograph illustrating a metallurgical structure of a cast product obtained by casting the aluminum alloy No. 1 under the casting condition No. 1.

On the other hand, Sample Nos. 2–4 and 6–8, which were obtained by casting the same aluminum alloys but under different casting conditions, were poor of ductility and had the metallurgical structures that size of an α-Al grains in a surface layer was greatly different from that in an inner part and that eutectic Si particles were significantly segregated.

Figure 3:
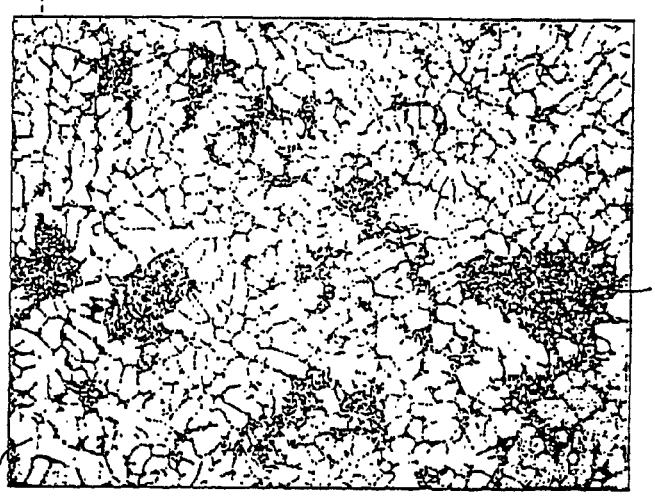
FIG. 3 is another microscopic photograph illustrating a metallurgical structure of an aluminum alloy product having a different composition.

Sample No. 9, which was obtained by casting the aluminum alloy No. 3 of different composition under the casting condition No. 1, was poor of ductility, although a difference in size of α-Al grains between a surface layer and an inner part was nearly the same level as that of Sample No. 1. When the metallurgical structure of Sample No. 9 was observed, segregation of coarse eutectic Si particles was detected, as shown in FIG. 3.

Figure 4:
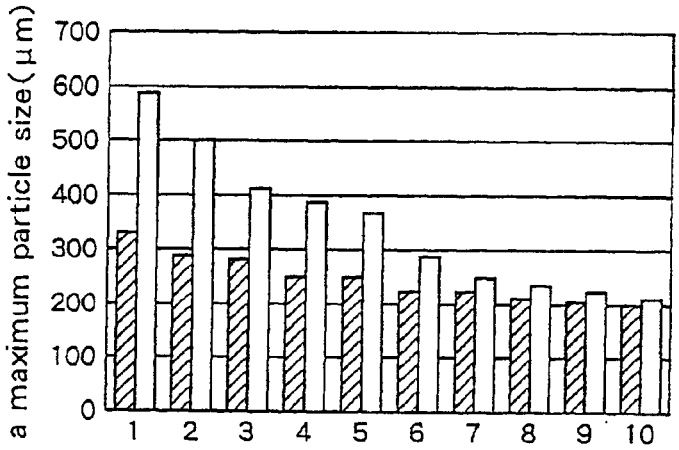
FIG. 4 is a graph for comparing maximum sizes of segregates in Sample No. 1 with Sample No. 9 by image-analysis of metallurgical structures.

Maximum diameters of segregates of eutectic Si particles were measured by image-analysis of the metallurgical structures (FIGS. 2 and 3), and classified to 10 grades. Sizes of segregates at each grade were compared together, as shown in FIG. 4. It is also recognized in FIG. 4 that the segregates in Sample No. 1 (the present invention) were smaller than those in Sample No. 9 (Comparative Example).

TABLE 3

EFFECTS OF ALLOYING COMPOSITIONS AND CASTING CONDITIONS ON PROPERTIES AND METALLURGICAL STRUCTURES

| Sample No. | Alloy No. | casting condition No. | tensile strength (MPa) | 0.2%-yield strength (MPa) | Elongation (%) | difference in grain size (μm) | porosity (%) | maximum size (μm) of eutectic Si particles |
|---|---|---|---|---|---|---|---|---|
| 1 | 1 | 1 | 291 | 243 | 12.8 | <10 | 0.413 | 330 |
| 2 | 1 | 2 | 287 | 237 | 8.7 | <40 | 0.796 | 441 |
| 3 | 1 | 3 | 279 | 240 | 6.6 | <50 | 0.731 | 455 |
| 4 | 1 | 4 | 294 | 241 | 7.8 | <40 | 0.688 | 478 |
| 5 | 2 | 1 | 293 | 241 | 11.6 | <5 | 0.371 | 328 |
| 6 | 2 | 2 | 278 | 230 | 7.6 | <40 | 0.881 | 431 |
| 7 | 2 | 3 | 291 | 236 | 7.3 | <50 | 0.588 | 454 |
| 8 | 2 | 4 | 283 | 240 | 6.9 | <60 | 0.534 | 410 |
| 9 | 3 | 1 | 282 | 236 | 9.3 | <10 | 0.856 | 579 |

10 test pieces were prepared from every cast product of Sample Nos. 1–9 and subjected to a calking test as follows: A regulator 4 was arranged in a cave 3 of a cast product 2, as shown in FIG. 1(*a*). A working pressure F was applied to a part above the cave 3 to clamp the regulator 4 between a bottom of the cave 4 and a plastically deformed part 5, as shown in FIG. 1(*a*). Thereafter, the plastically deformed part 5 was inspected to detect occurrence of cracks.

Results are shown in Table 4. It is apparently noted that any of Sample Nos. 1 and 5 was plastically deformed for coupling the regulator 4 without occurrence of cracks. On the other hand, test pieces of Sample Nos. 2–4 and 6–9 were often cracked after the plastic deformation. By observing a metallurgical structure of the test piece which was cracked after the plastic deformation, it was recognized that segregates of coarse eutectic particles act as origins for cracking.

TABLE 4

TENDENCY OF CRACKINGS IN EACH CAST PRODUCT AFTER A CALKING TEST (n = 10)

| Sample No. | 1 | 2 | 3 | 4 | 5 | 6 | 7 | 8 | 9 |
|---|---|---|---|---|---|---|---|---|---|
| number of cracked test pieces | 0 | 6 | 8 | 10 | 0 | 6 | 7 | 10 | 8 |

A cast aluminum alloy product according to the present invention as above-mentioned, is reformed to such the metallurgical structure that an average size of α-Al grains in a surface layer is near an average size of α-Al grains in an inner part without segregation of coarse eutectic Si particles by addition of Ti, B and Ca with reduction of P content. Due to the reformed structure, the cast product can be plastically deformed by calking or the like for coupling another member therewith. Therefore, the cast product is useful in various technical fields, instead of an expensive ductile aluminum alloy which has been used so far for such the purpose. The cast product is also superior of airtightness, so useful as a protector for an automobile braking system enclosing a hydraulic circuit therein.

What is claimed is:

1. A method of coupling a cast aluminum alloy product with another member using plastic deformation, which comprises the steps of:

preparing a molten aluminum alloy having a composition consisting of 6.5–8.0 mass % Si, 0.25–0.45 mass % Mg, 0.08–0.40 mass % Fe, 0.001–0.01 mass % Ca, P less than 0.0015 mass %, 0.02–0.1 mass % Ti, 0.001–0.01 mass % B, optionally one or two of 0.05–0.3 mass % Cr and 0.05–0.2 mass % Mn, and the balance being Al except inevitable impurities;

injecting said molten alloy into a cavity of metal dies at a speed of 0.05–0.25 m/second, so as to shape a cast body to a profile having a cave or hole;

cooling said injected molten alloy at a cooling speed of 200° C./second or higher in a temperature range between liquidus and solidus curves of said aluminum alloy in a state charged with a pressure of 30MPa or more;

arranging another member in said cave or hole of said cast body; and coupling said another member to said cast body by plastic flow of an alloy at a part above or around said cave or hole to said cave or hole.

* * * * *

UNITED STATES PATENT AND TRADEMARK OFFICE

CERTIFICATE OF CORRECTION

PATENT NO. : 6,866,085 B2
DATED : March 15, 2005
INVENTOR(S) : Hashimoto et al.

It is certified that error appears in the above-identified patent and that said Letters Patent is hereby corrected as shown below:

Column 8,
Line 18, "200° C./second" should read -- 20° C./second --.

Signed and Sealed this

Fourth Day of October, 2005

JON W. DUDAS
*Director of the United States Patent and Trademark Office*